United States Patent [19]

Morrison

[11] Patent Number: 5,024,030

[45] **Date of Patent: * Jun. 18, 1991**

[54] SPACE DIVIDER SYSTEM

[75] Inventor: Andrew I. Morrison, East Setauket, N.Y.

[73] Assignee: Knoll International, Inc., New York, N.Y.

[ * ] Notice: The portion of the term of this patent subsequent to Feb. 4, 2003 has been disclaimed.

[21] Appl. No.: 803,552

[22] Filed: Dec. 2, 1985

Related U.S. Application Data

[62] Division of Ser. No. 560,877, Dec. 13, 1983.

[51] Int. Cl.[5] ..... B24B 7/00

[52] U.S. Cl. ..... 52/36

[58] Field of Search ..... 211/189; 403/335, 309; 312/140, 257 R, 257 SK, 258, 263; 52/282, 285, 239, 246, 584

[56] References Cited

U.S. PATENT DOCUMENTS

| | | | |
|---|---|---|---|
| 3,164,260 | 1/1965 | Seemann | 211/189 |
| 3,425,171 | 2/1969 | Propst et al. | 52/239 |
| 3,517,467 | 6/1970 | Propst et al. | 52/239 |
| 4,093,078 | 6/1978 | Radek | 211/189 |
| 4,325,597 | 4/1982 | Morrison | 312/258 |
| 4,567,698 | 2/1986 | Morrison | 52/239 |

*Primary Examiner*—Joseph Falk

*Attorney, Agent, or Firm*—Michael Ebert

[57] ABSTRACT

A spacer divider system adapted to partition an interior space into working sub-areas wherein desks, cabinets, and other work components are integrated with partition walls formed by modular panels that are interlocked in a spatial pattern defining the desired sub-areas or work stations. Each panel includes a frame whose corners have recesses therein bordered by side ledges. To join two or more panels in side-by-side relation to create a planar partition wall, sandwiched between the adjoining vertical sides of the panels is a standard having a longitudinal row of slots on opposing faces thereof and a threaded socket at either end. The panels are locked together at their top and bottom by a clamp which bridges the complementary side ledges of the panels and is secured to the standard by a screw received in the end socket. To join one panel at right angles to another, use is made of a four-sided connector post whose ends are notched to create a ledge on each side. In this case, clamps screwed into the end sockets of standards placed against the vertical sides of the panels to be joined, act to bridge the complementary side ledges of the connector post and the panels. The work components are provided with rear brackets having a series of hooks thereon which are received in the slots of the standards to cantilever the components therefrom.

1 Claim, 12 Drawing Sheets

Fig. 8.
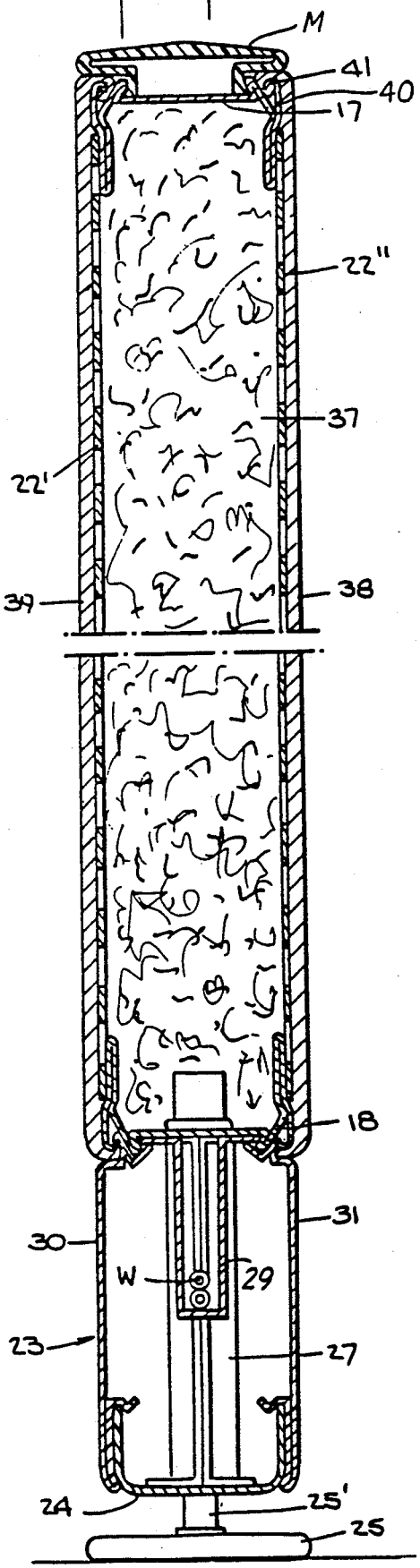
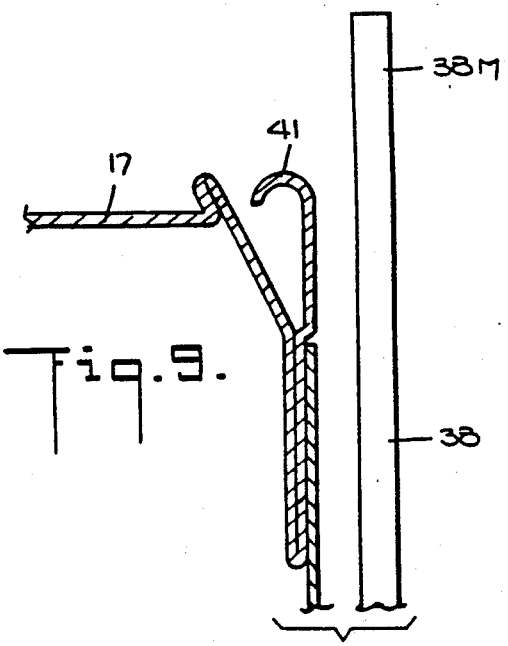
Fig. 9.
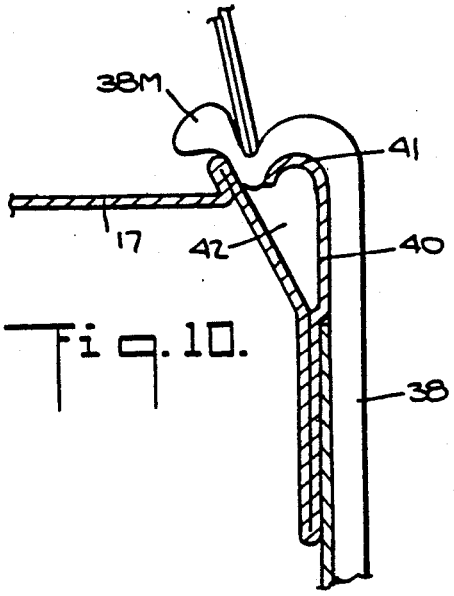
Fig. 10.
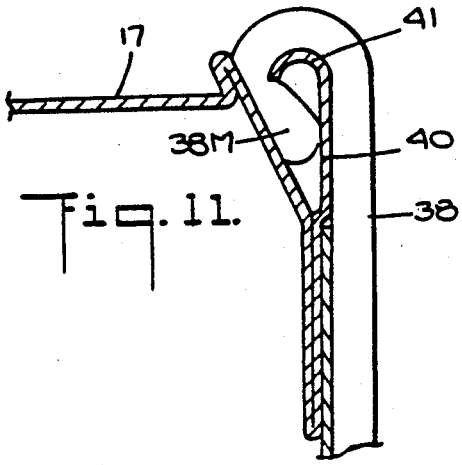
Fig. 11.

SPACE DIVIDER SYSTEM

RELATED APPLICATION

This application is a division of my copending application Ser. No. 560,877, filed Dec. 13, 1983, of the same title, whose entire disclose is incorporated herein by reference.

BACKGROUND OF INVENTION

Field of Invention

This invention relates generally to space divider systems for subdividing an interior space into working sub-areas, and more particularly to a system of this type in which work components such as shelves and cabinets are integrated with interlocked modular panels which define the spatial pattern created by the system, the system being capable of being readily disassembled and re-erected in an entirely new pattern.

In order to meet the changing requirements for commercial or industrial interiors, it is now known to divide the available space into sub-areas or work stations by means of a space divider system composed of free-standing panels that are joined together in a spatial pattern defining the desired sub-areas. Each sub-area or station is then furnished with work components such as file cabinets, desks and shelves. Among prior patents disclosing such space divider systems are the U.S. Pat. Nos. to Morrison, 4,325,597; and Prospt et al., 3,425,171.

Existing space divider systems lack adequate versatility and flexibility, for they are limited in their capacity to form different patterns of space division, and they cannot be quickly disassembled and re-erected without employing skilled personnel for this purpose.

It is common practice to form a pattern of sub-areas or work stations by means of standardized free-standing panels that can be interlocked to form partition walls in a desired configuration. The work stations created by this pattern are then furnished with traditional desks, cabinets and other useful articles.

In order to cope with new situations as they are encountered in modern corporate life, changes are frequently made in production, marketing and accounting strategies. The need, therefore, often arises at corporate facilities to rearrange the existing set-up of work stations, desks and all other work components into a new pattern that serves to carry out a newly-adopted work plan. Also, in some instances, it may be necessary to transfer the entire system from one corporate site to another.

The use of traditional furniture pieces in conjunction with a conventional space divider system creates problems, for these pieces are inherently inflexible. Thus, if a corporation decides to transfer its accounting department to a floor at its headquarters presently occupied by its engineering staff and to transfer this staff to a new site, with traditional furniture this represents a formidable task that is difficult to execute in short order, however urgent the need to carry out this plan with a minimum of dislocation and loss of time.

Another drawback of existing space divider systems is that the panels which form the partition walls are lacking in desirable aesthetic and acoustic properties, and they impart a raw functional appearance to the divided interior space the militates against an efficient operation. Thus the use of framed glass or plastic panels in room dividers is not only unappealing, but because such panels reflect rather than absorb sound, they magnify noise and disturb the working personnel.

Moreover, existing space divider systems fail to take into account the fact that work stations must in many instances operate with telephone and computer lines as well as with power lines to energize light fixtures, typewriters and other equipment. Consequently, after the space divider is set up, it is necessary then to install duct work for protectively concealing the communication and power lines.

SUMMARY OF INVENTION

In view of the foregoing, the main object of this invention is to provide a versatile and flexible space divider system adapted to partition an open interior space into working sub-areas, which system makes use of free-standing modular panels that may readily be interlocked to create stable partition walls in a broad range of space patterns forming desired sub-areas.

More particularly an object of this invention is to provide a divider system whose modular panels may be assembled and re-assembled without difficulty into various space patterns formed by panels in side-by-side or in right angle relation to create alcoves as well as partition walls.

A significant advantage of a system in accordance with the invention is that the modular panels are of high structural strength, yet are relatively light in weight, so that the panels are easy to handle and may be stored or transported in a stacked state.

Also an object of this invention is to provide a space divider system whose modular panels may be assembled and re-assembled without difficulty into various space patterns formed by panels in side-by-side or in right angle relation to create alcoves as well as partition walls.

Yet another object of this invention is to provide a space divider system whose modular panels incorporate sound absorbing material and are faced with a replaceable fabric sheet so that the panels have good acoustic properties as well as an attractive appearance.

A salient feature of the invention is that the panels are supported on a base incorporating a duct through which one may run communication and power lines, thereby protectively concealing these lines.

Still another object of the invention is to provide a system composed of modular panels which may be interlocked by simple mechanical means, whereby the system may be erected or disassembled by personnel having minimal skills.

Briefly stated, these objects are accomplished by a spacer divider system adapted to partition an interior space into working sub-areas wherein desks, cabinets, and other work components are integrated with partition walls formed by modular panels that are interlocked in a spatial pattern defining the desired sub-areas or work stations. Each panel includes a frame whose corners have recesses therein bordered by side ledges. To join two or more panels in side-by-side relation to create a planar partition wall, sandwiched between the adjoining vertical sides of the panels is a standard having a longitudinal row of slots on opposing faces thereof and a threaded socket at either end. The panels are locked together at their top and bottom by a clamp which bridges the complementary side ledges of the panels and is secured to the standard by a screw received in the end socket. To join one panel at right angles to another, use is made of a four-sided connector post whose ends are notched to create a ledge on each side. In this case, clamps screwed into the end sockets of standards placed against the vertical sides of the panels to be joined, act to bridge the complementary side ledges of the connector post and the panels. The work components are provided with rear brackets having a series of hooks thereon which are received in the slots of the standards to cantilever the components therefrom.

OUTLINE OF DRAWINGS

For a better understanding of the invention as well as other objects and further features thereof, reference is made to the following detailed description to be read in conjunction with the drawings, wherein:

FIG. 8 is a section taken in the plane indicated by line 8—8 in FIG. 1;

FIGS. 9, 10 and 11 illustrate the successive steps by which the margin of a fabric sheet is stuffed into a storage channel formed in of the panel;

DESCRIPTION OF INVENTION

The Spatial Pattern

Figure 1:
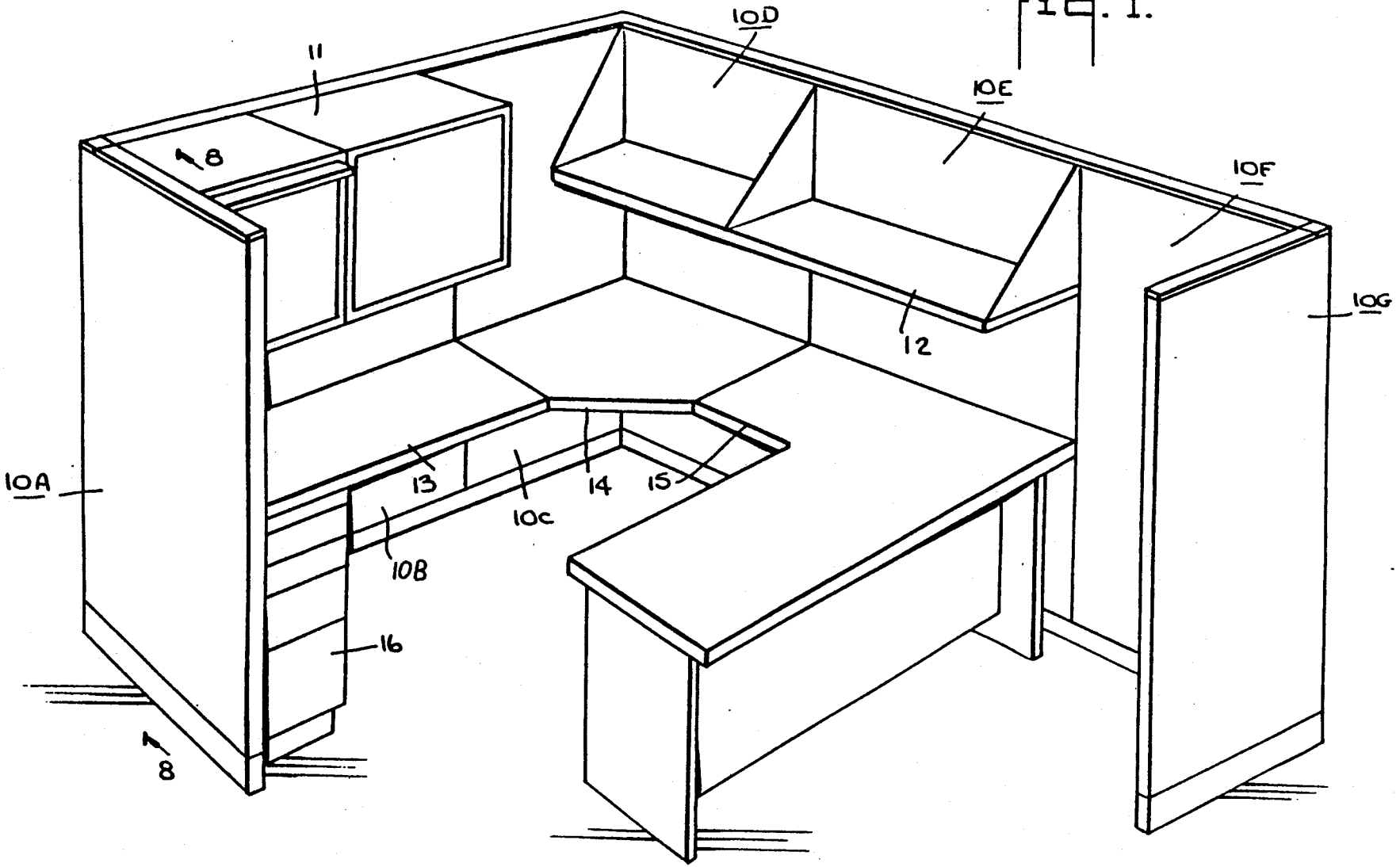
FIG. 1 is a perspective view of a work station created by a space divider system in accordance with the invention.

Referring now to FIG. 1, there is shown a space divider system in accordance with the invention adapted to create a desired spatial pattern in an interior. The system is composed of free standing modular panels 10A to 10G that are interlocked to create a work station in which panels 10B and 10C are joined together in side-by-side relation to form a short partition wall at right angles to a longer partition wall formed by panels 10D, 10E and 10F, also joined together in side-by-side relation. Panel 10A is at right angles to the free end of the short wall, while panel 10G is at right angles to the longer wall to create an alcove.

Cantilevered from panel 10B is an overhead cabinet 11, and cantilevered from panels 10D and 10E is a shelf 12. Table surfaces 13, 14, and 15 are cantilevered from the panels, surface 13 resting on a set of drawers and surface 15 on a base 16.

The spatial pattern shown in FIG. 1 is merely by way of illustrating one of many possible space divisions. As will later be evident, the panels may be joined serially in side-by-side relation as well as in right angle relation to sub-divide a space in any desired manner. But regardless of the pattern, it has a right angle geometry to create three-dimensional working stations.

The Modular Panels

Figure 3:
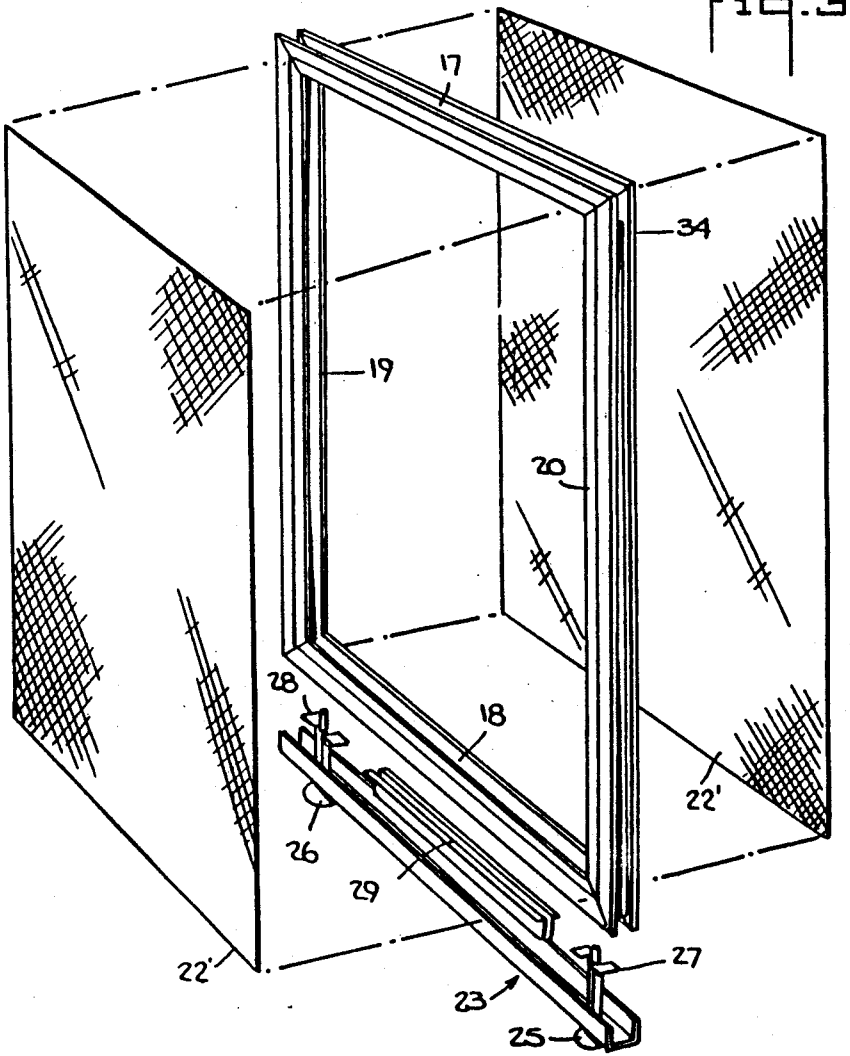
FIG. 3 is an exploded view of the frame, its facings and the base for supporting the frame.
Figure 2:
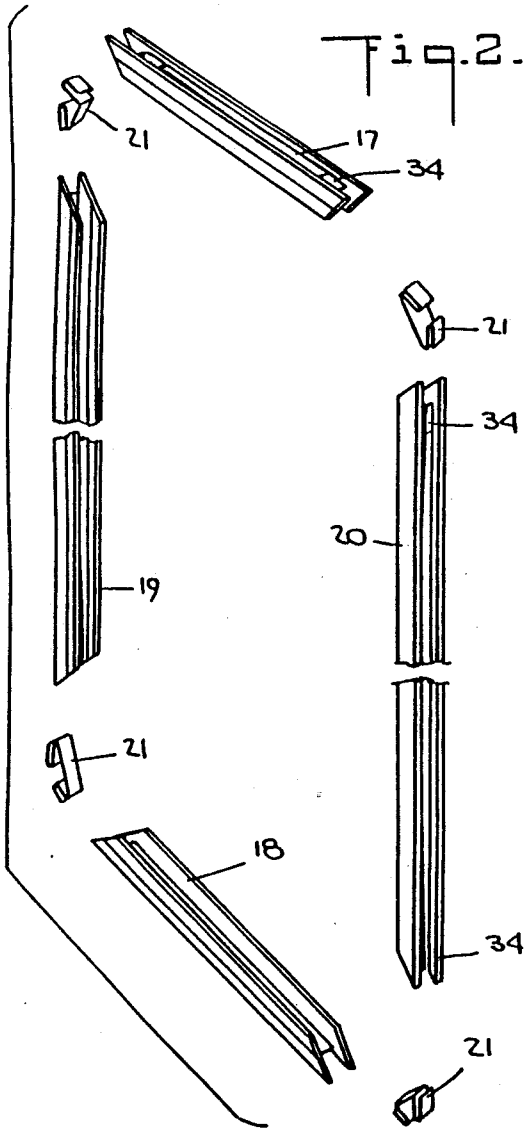
FIG. 2 is an exploded view of the elements of a frame for the modular included in the system.

Each panel, as shown separately in FIGS. 2 and 3, includes a rectangular frame composed of mitered top and bottom and side channel pieces 17, 18, 19 and 20 which are held together at their corners by four identical clips 21. Bonded to the opposing faces of the frame are sheets 22' and 22'' which may be of expanded metal or other light weight material. The panel rests on a base 23 which is shown in greater detail in FIG. 4.

Figure 4:
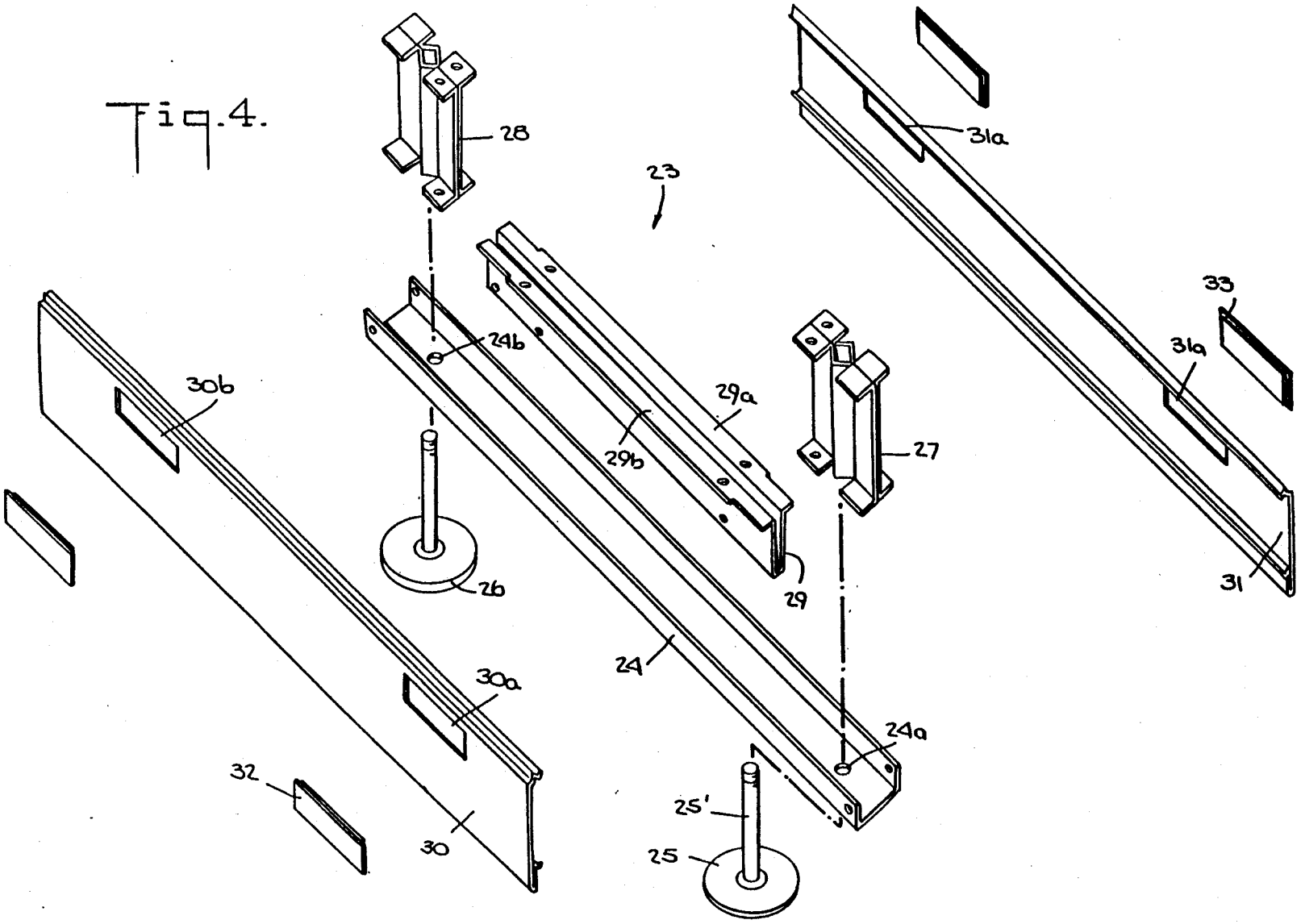
FIG. 4 is an exploded view of the several elements which compose the base.

Referring now to FIG. 4, it will be seen that base 23 is constituted by a channel element 24 whose floor is provided with holes **24*a* and 24*b* through which are inserted the stems 25' and 26' of ground pedestals 25 and 26. These stems extend through tubes formed in spacer elements 27 and 28 on which the lower piece 18 of the panel frame is mounted at a position raised above element 24. Suspended from the lower piece of the panel and contained within channel element 24 between spacer elements 27 and 28 is a narrow duct 29. The duct is formed by parallel vertical walls having upper flanges 29*a* and 29*b* which are secured to the lower piece 18** of the panel frame.

A raceway is created by side plates 30 and 31 which, as shown in FIG. 8, snap onto the opposite sides of channel element 24 and the lower piece 18 of the frame and are provided with windows **30*a* and 30*b* having removable covers 32 and 33** to permit the installation in the windows of electrical outlets.

Figure 20:
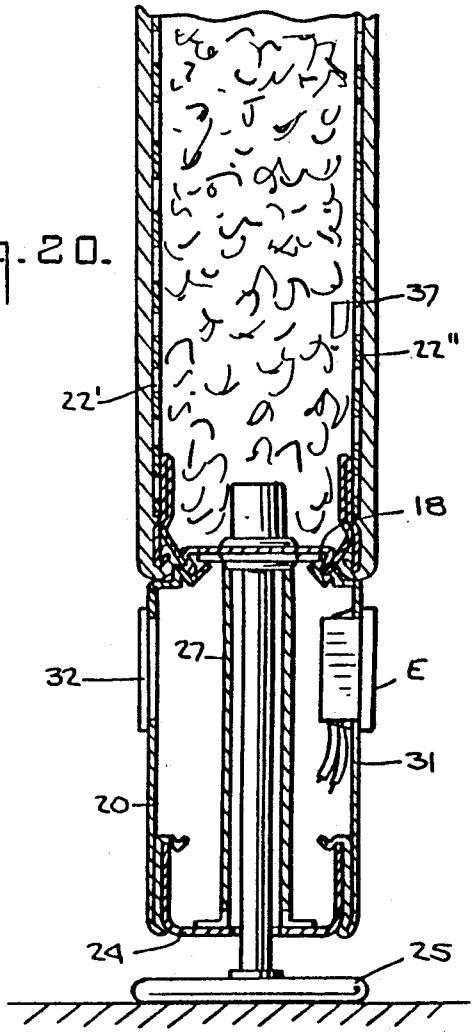
FIG. 20 is a longitudinal section taken through the base and the panel supported thereby.
Figure 19:
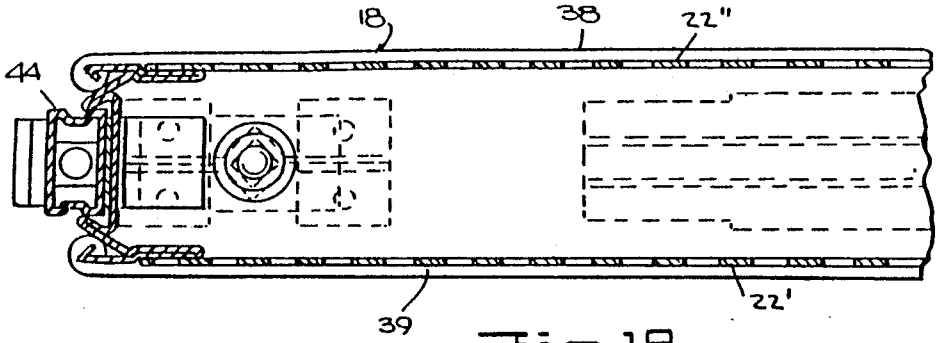
FIG. 19 is a plan view of the base.
Figure 18:
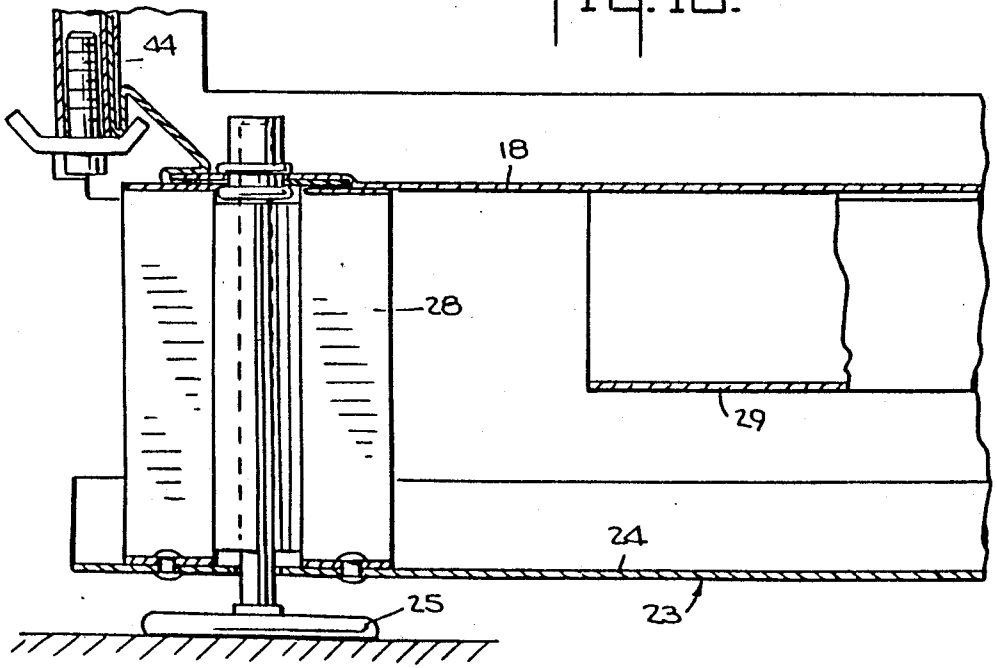
FIG. 18 is a sectional view of the base for supporting a panel.

Also shown in FIG. 8 are wires W which run through duct 29. These wires may be telephone and other low-voltage communication lines. As shown in FIG. 20, an electrical outlet E is installed in side plate 31 of the raceway 23 connected to power lines running through the raceway. The window in side plate 30 remains covered by cover plate 32.

As shown in FIG. 2, frame pieces 17 to 20 are provided adjacent each end thereof with transverse struts 34 which are engaged by the jaws of clips 21 to hold the pieces together in a rectangular frame formation. These clips are shown in greater detail in FIGS. 12 and 13 where it will be seen that each clip is formed by a strip of metal whose ends are folded over to define jaws 21A and 21B at right angles to each other, the jaws being interconnected by the midportion 21C of the strip which is at a 45-degree angle thereto.

When jaws 21A and 21B engage the struts 34 of the frame pieces 17 to 20 to form the corners of the frame, the corners then each have a side entry or recess 35 and horizontal and vertical side ledges which border this recess, these side ledges being formed by the clip jaws in engagement with the struts. The side ledges are provided with threaded bores 36 to receive holding screws.

In order to impart sound-absorbing properties to the panels, installed within the panel frame between metal sheets 22' and 22", as shown in FIGS. 8 and 20, is a pad 37 of light-weight sound-absorbent material. To finish the panel and impart an attractive appearance thereto, the panel is covered on either face by fabric sheets 38 and 39 whose margins are stuffed into a storage channel 42 which runs along the periphery of the frame. This storage channel is formed by a resilient metal leaf 40 whose free end is bent into a crook 41 that is spaced from the frame to create the restricted entry to the channel.

The manner by which a fabric sheet is attached to the frame is illustrated in FIGS. 9, 10 and 11. In FIG. 9, it will be seen that fabric sheet 38 is first brought to a position parallel to the frame in which its margins 38M extends above storage channel 42. Then by means of the blade 43 of a hand tool, as shown in FIG. 10, margin 38 is forced into the restrict ed entry of storage channel 42, the resilient leaf 40 yielding to permit such entry. The margin is thereby caused to fold over crook 41 to rest within the storage channel and thereby retain the fabric sheet against the frame. Thus the rectangular dimensions of the fabric sheet must somewhat exceed those of the frame to allow for margins to be stuffed into the peripheral storage channel.

Since the fabric sheets which represent the external faces of the panel are exposed to the public, they are subject to wear and tear as well as soiling. But because these fabric sheets, though firmly secured to the frame are readily removable therefrom by the same tool which can then be used to pry open the entry to the storage channel, a damaged or soiled fabric can be replaced without difficulty. Or if a decor change is made in the interior space requiring a different color or wall texture scheme, the panels may then be provided with fabrics appropriate to this scheme.

In order to finish the panels and conceal the clips and other internal elements, mouldings M are provided, as shown in FIG. 8, which snap onto the frame pieces.

While the frame shown is composed of separate pieces which are united by corner clips which create side ledges, in practice the frame may be made of pieces that are welded together and which include horizontal and vertical side ledges; for these ledges, as will later be evident, are essential for interlocking the panels into a desired spatial pattern.

Standards and Connector Posts

Regardless of the spatial pattern to be created, the modular panels must be interlocked in side-by-side relation to form planar partition walls, and they must also be interlocked in right angle relation to create walls normal to the partition wall.

The elements necessary in a system in accordance with the invention to provide side-by-side and right-angle panel junctions are a standard 44 and a connector post 45. These elements are mechanically coupled to the panels by means of clamps 46 which are secured to the ends of the standards by screws 47.

Figure 5:
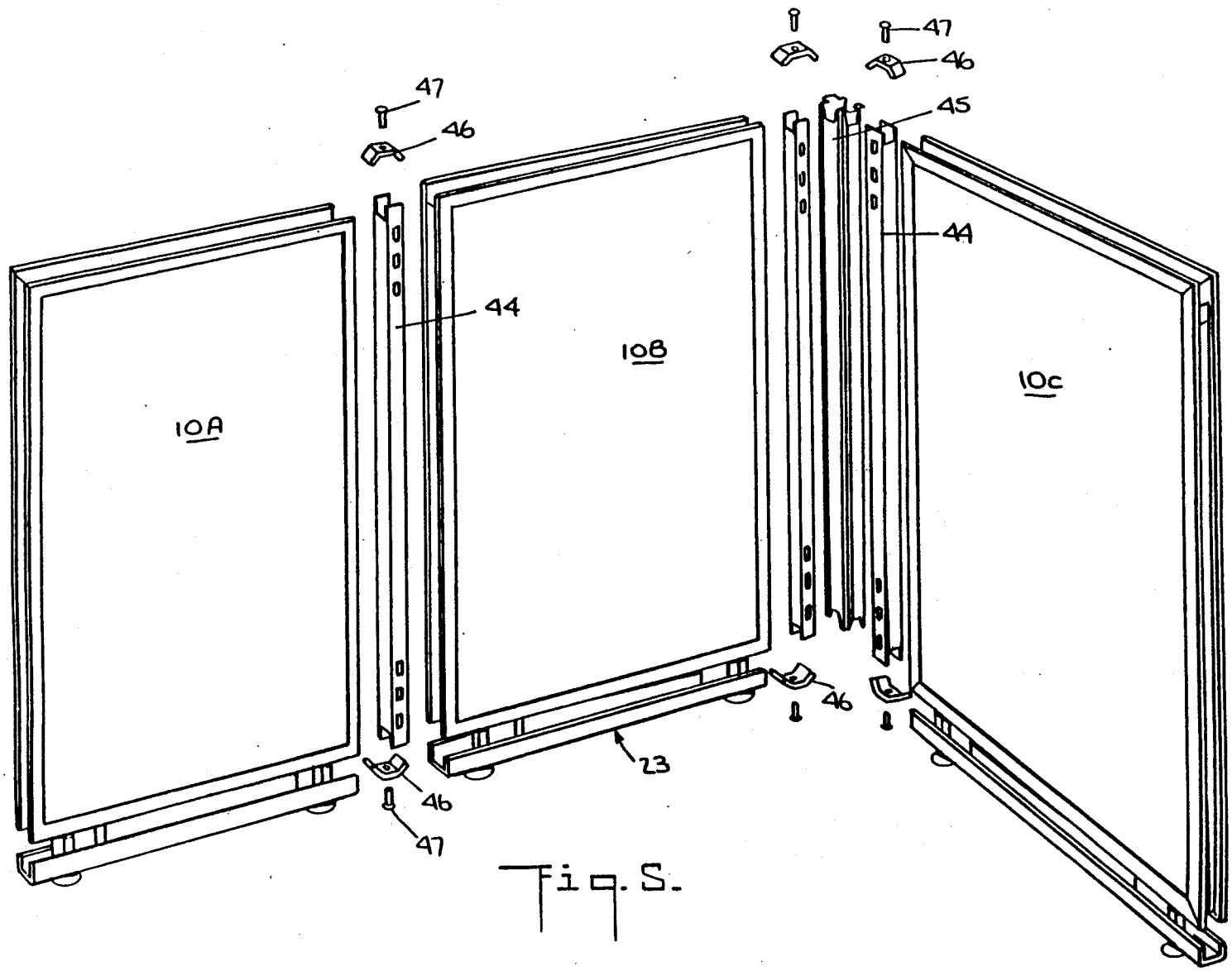
FIG. 5 is a perspective view of three modular panels in accordance with the invention which are so joined together that two are in side-to-side relation to create a partition wall to which the panel is joined at right angles thereto.

The basic interlocking arrangement is illustrated in FIG. 5, where it will be seen that modular panels 10A and 10B are joined together in side-by-side relation by a standard 44 which is sandwiched between the adjacent vertical sides of the panel frames, the panels being interlocked by clamps 46 secured to the ends of the standard by screws 47.

Panel 10C is joined to panel 10B at right angles thereto by connector post 45. In this arrangement, panel 10B is locked to one side of this post by means of a standard 44 interposed between the panel side and the corresponding side of the post, and another standard 44 interposed between a side of the post at right angles to the one side and the corresponding side of panel 10C. Clamps 46 and screws 47, which are secured to the two standards, serve to lock panels 10B and 10C to connector post 45 at right angles to each other.

Figure 12:
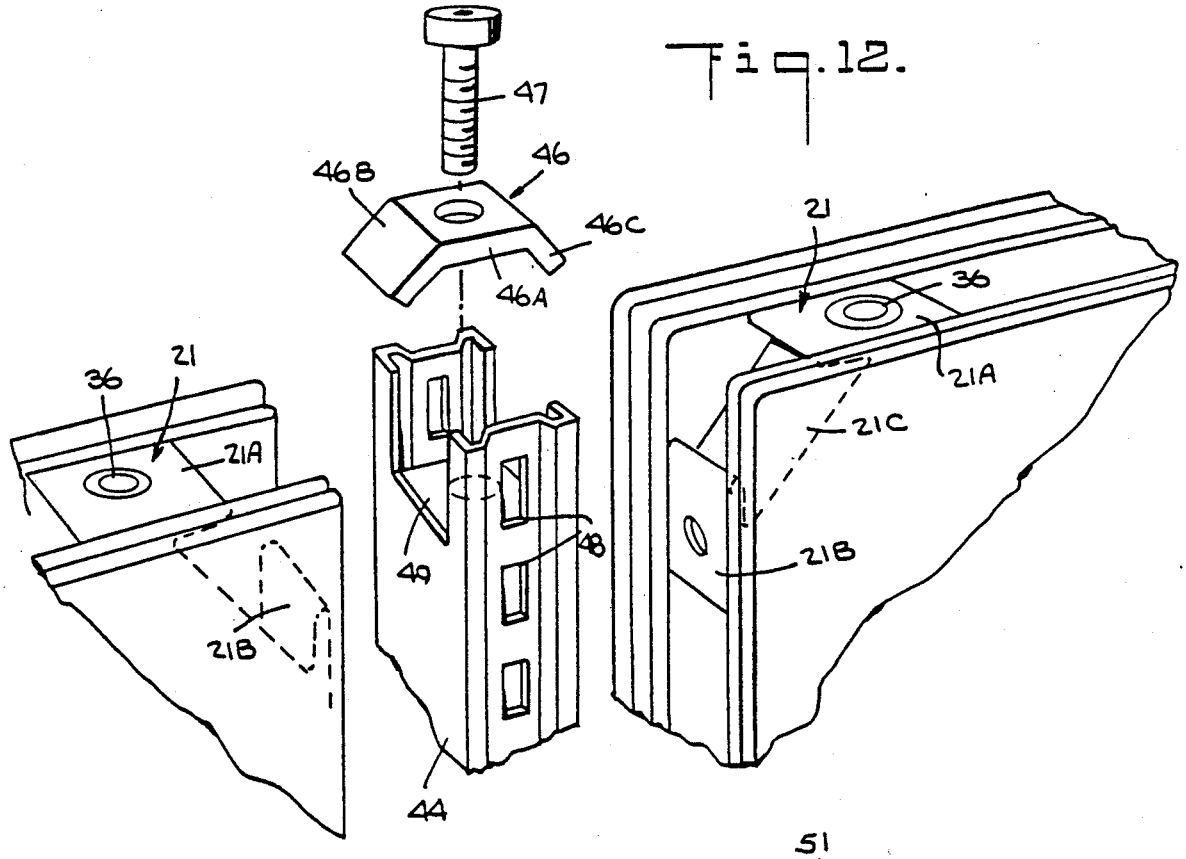
FIG. 12 illustrates the manner in which a clamp secured to an end socket in a standard sandwiched between the adjacent sides of two panel frames serves to interlock these frames.

As best seen in FIG. 12, each standard 44 which has a rectangular cross section is provided at either face thereof with a longitudinal row of rectangular slots 48 adapted to receive hooks for cantilevering a component from the standard. Each end of the standard has side notches to provide an end opening to accommodate the flat base 46A of clamp 46, from which base extend a pair of downwardly sloped wings 46B and 46C. Clamp base 46A has a center bore that registers with a threaded socket 49 when the base is seated thereon. (It is to be noted that the stems 26' of the pedestals of levelling devices 26 may be screwed into the bottom threaded socket 49 of a standard rather than onto the base of the panel frame.)

Figure 13:
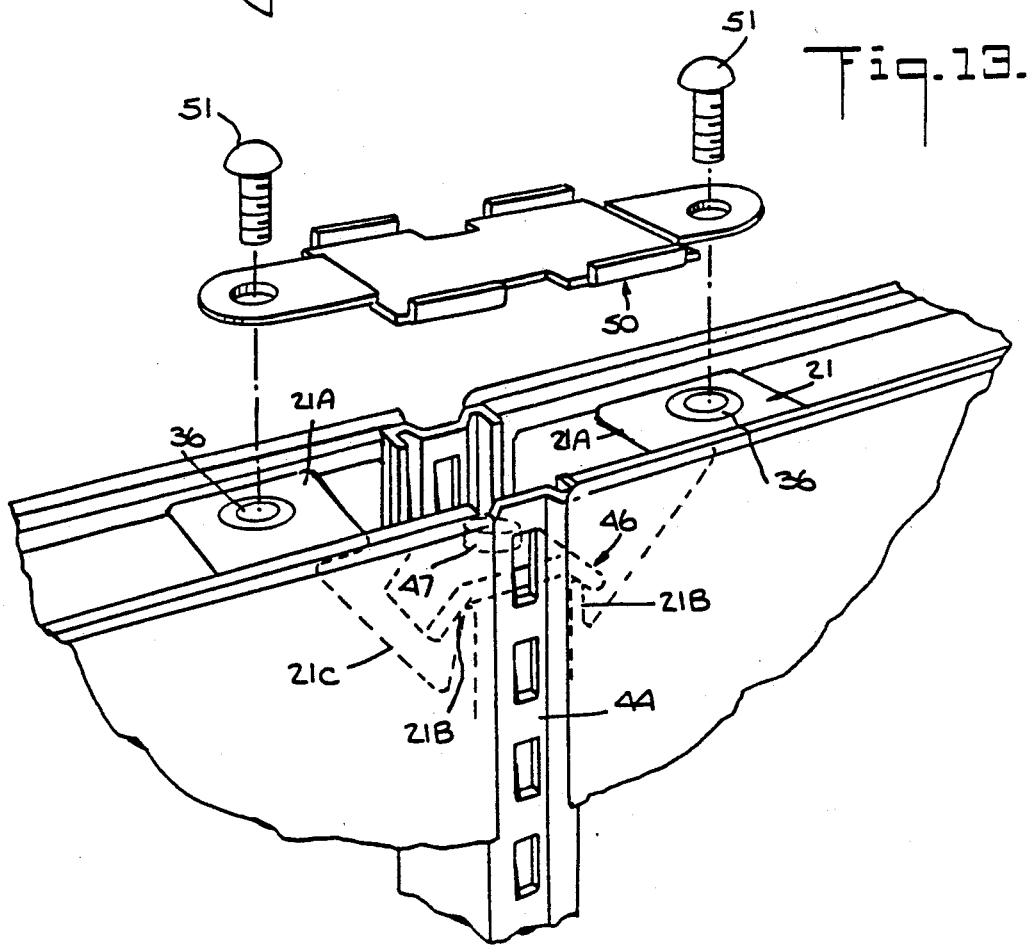
FIG. 13 illustrates how a stiffener plate acts to link two interlocked panel frames.
Figure 14:
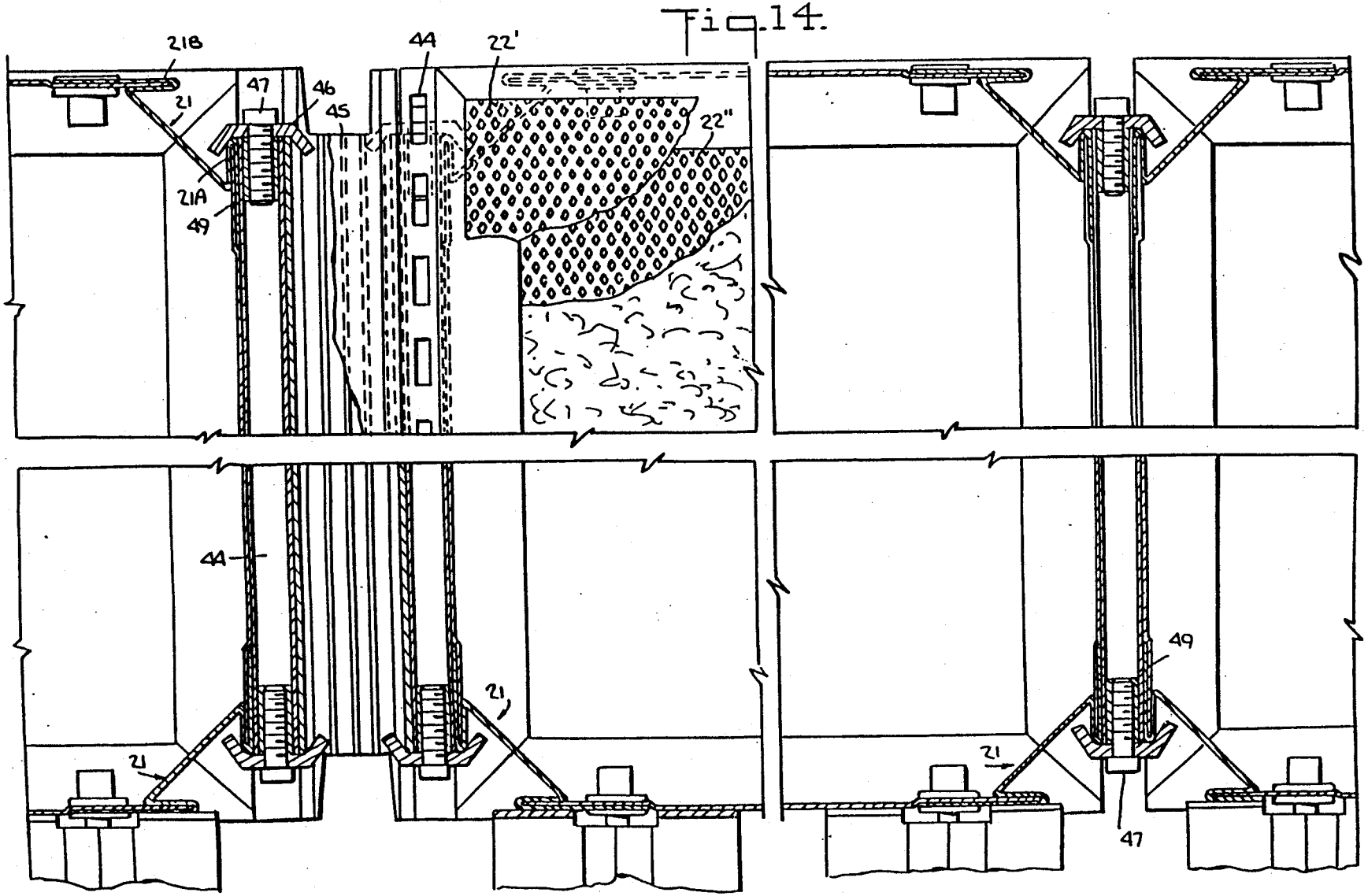
FIG. 14 shows a series of panels interconnected by standards and by connector posts.
Figure 15:
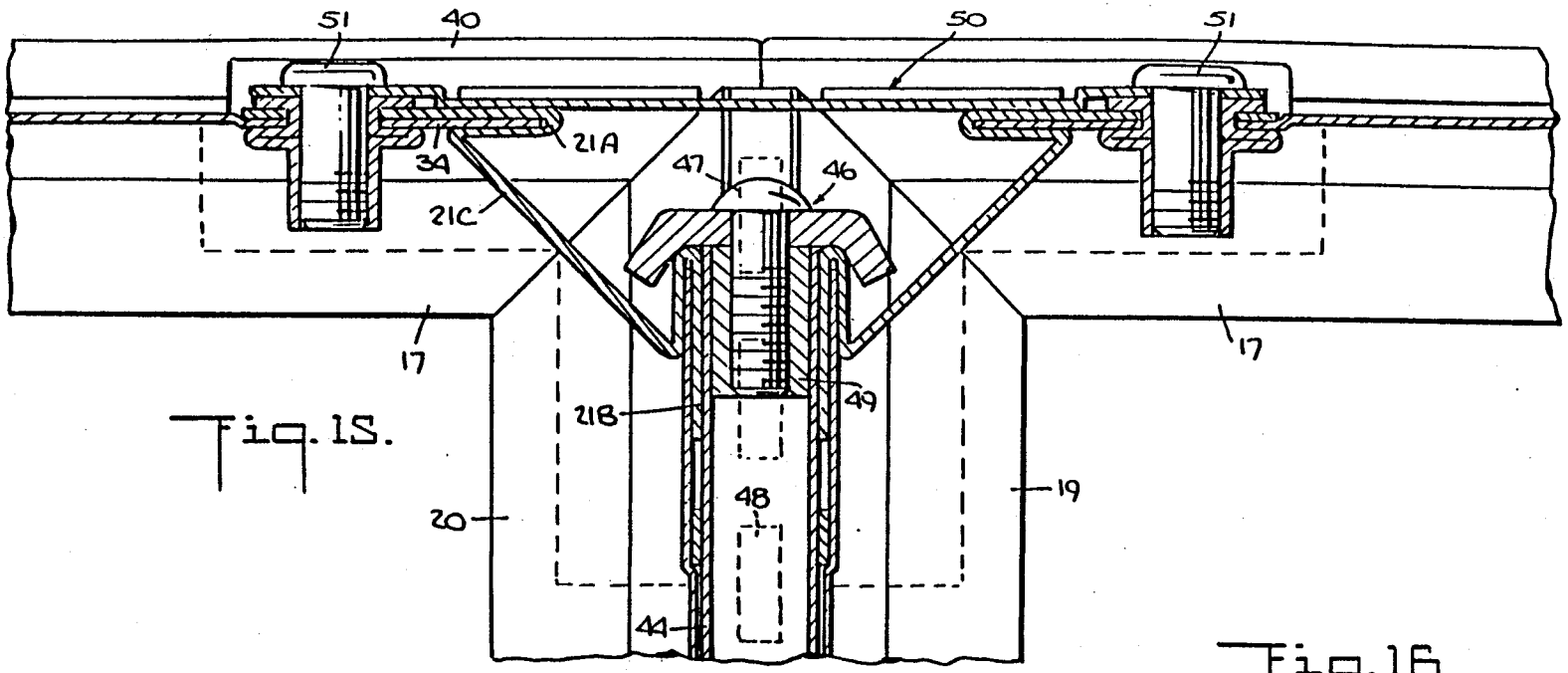
FIG. 15 is an enlarged sectional view showing how two panels are interlocked by means of a standard, a clamp and a stiffener plate.
Figure 16:
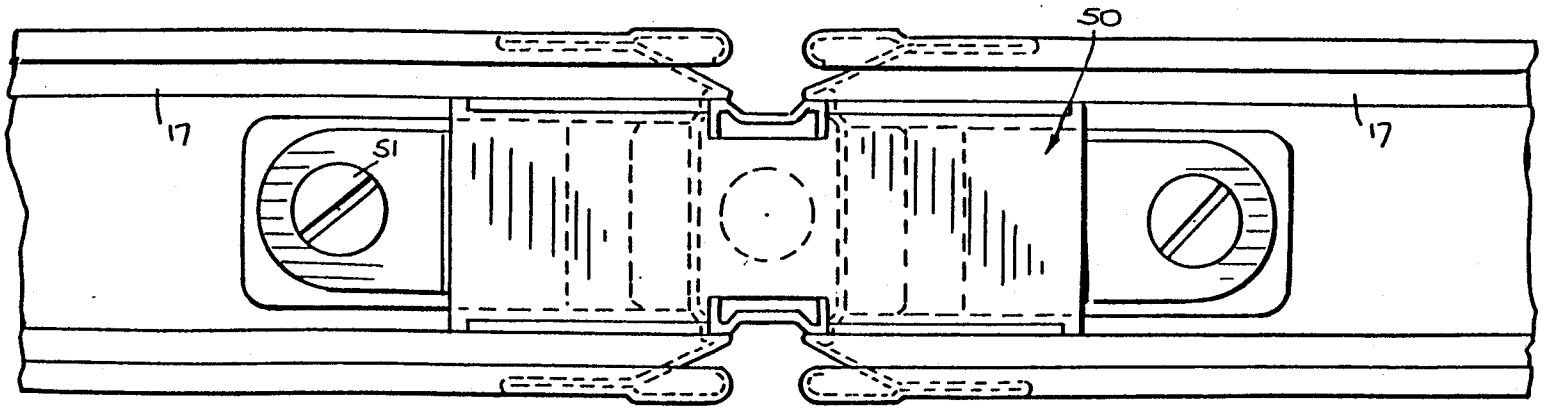
FIG. 16 is a top plan view of the two panels shown in FIG. 15.

Thus, as shown in FIGS. 12 and 13, when clamp 46 is seated on threaded socket 49 at the end of the standard, the downwardly sloped wings 46B and 46C then overlap the vertical side ledges 21B of the panel frames on either side of the standard. And when screw 47 is turned into socket 49 to secure the clamp to the standard, the clamp then serves to lock the panel frames together in a common plane. This screw turning action places standard 44 in tension, and as screw 47 is tightened, the panel frames on either side of the standard are drawn together by the wedging action of the downwardly-turned wings 46B and 46C acting against the vertical side ledges 21B. The same wedging action occurs when wings 46 serve to interconnect a panel frame to a post 45, as shown in FIG. 5.

To reinforce the interlock between the panel frames, a stiffener plate 50 is provided which straddles the end of the standard and is secured to the horizontal ledges 21A of the frames on either side of the standard by screws 51 which are received in the threaded bores 36.

Figure 21:
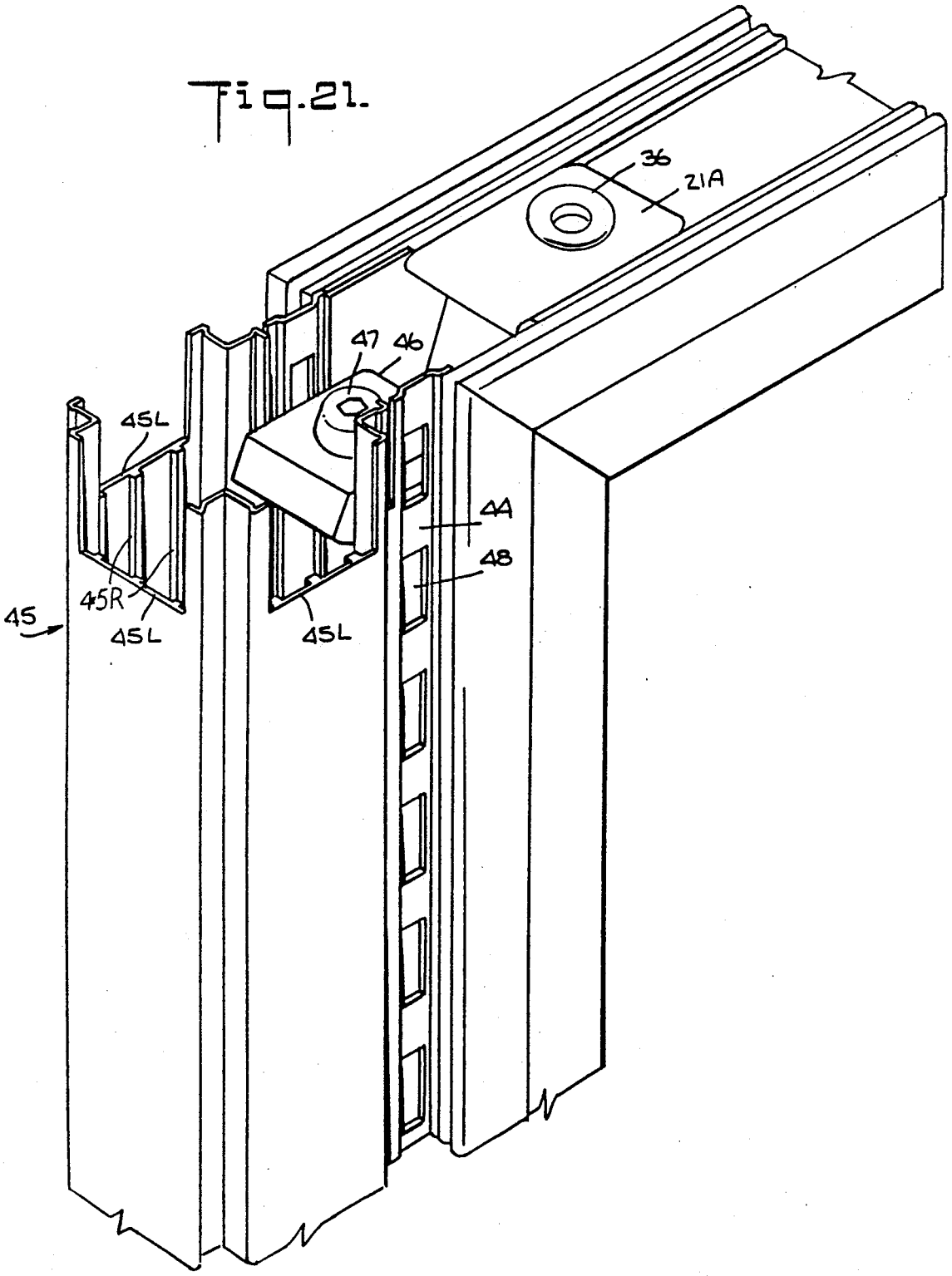
FIG. 21 is a perspective view illustrating how a connector post is joined to a panel by way of a standard.

Each connector post 45, as best seen in FIG. 21, is of hollow four-side construction, the inner surface of the sides having parallel reinforcing ribs 45R formed therein. The four sides of the ends of the post have rectangular notches cut therein to define side ledges 45L. Thus, to join one side of the connector post to the corresponding side of a panel frame, the side ledge of the post and the side ledge of the panel frame are locked together by a clamp 46 which is secured by a screw 47 to the threaded socket 49 in the end of a standard 44 interposed between the sides of the post and the frame.

Figure 17:
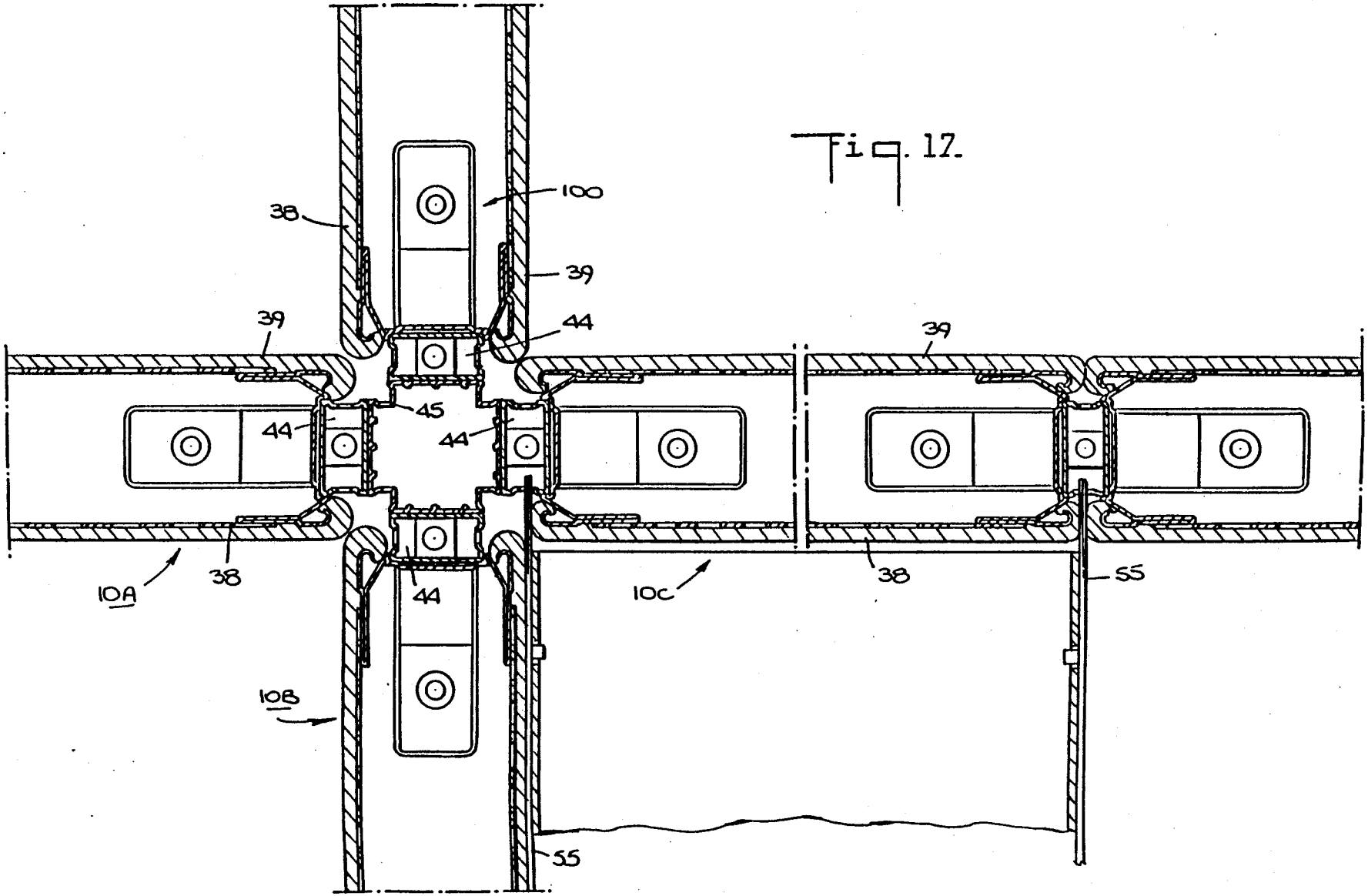
FIG. 17 is a top plan view of a connector post which serves to join panels at right angles to each other.

As shown in FIG. 17, the four-sided connector post makes it possible, should the spatial pattern to be erected so require, to connect panels 10A, 10B, 10C and 10D in a cruciform arrangement in which panel 10B and 10D are at right angles to panels 10A and 10C which lie in the same plane.

Figures 6, 7:
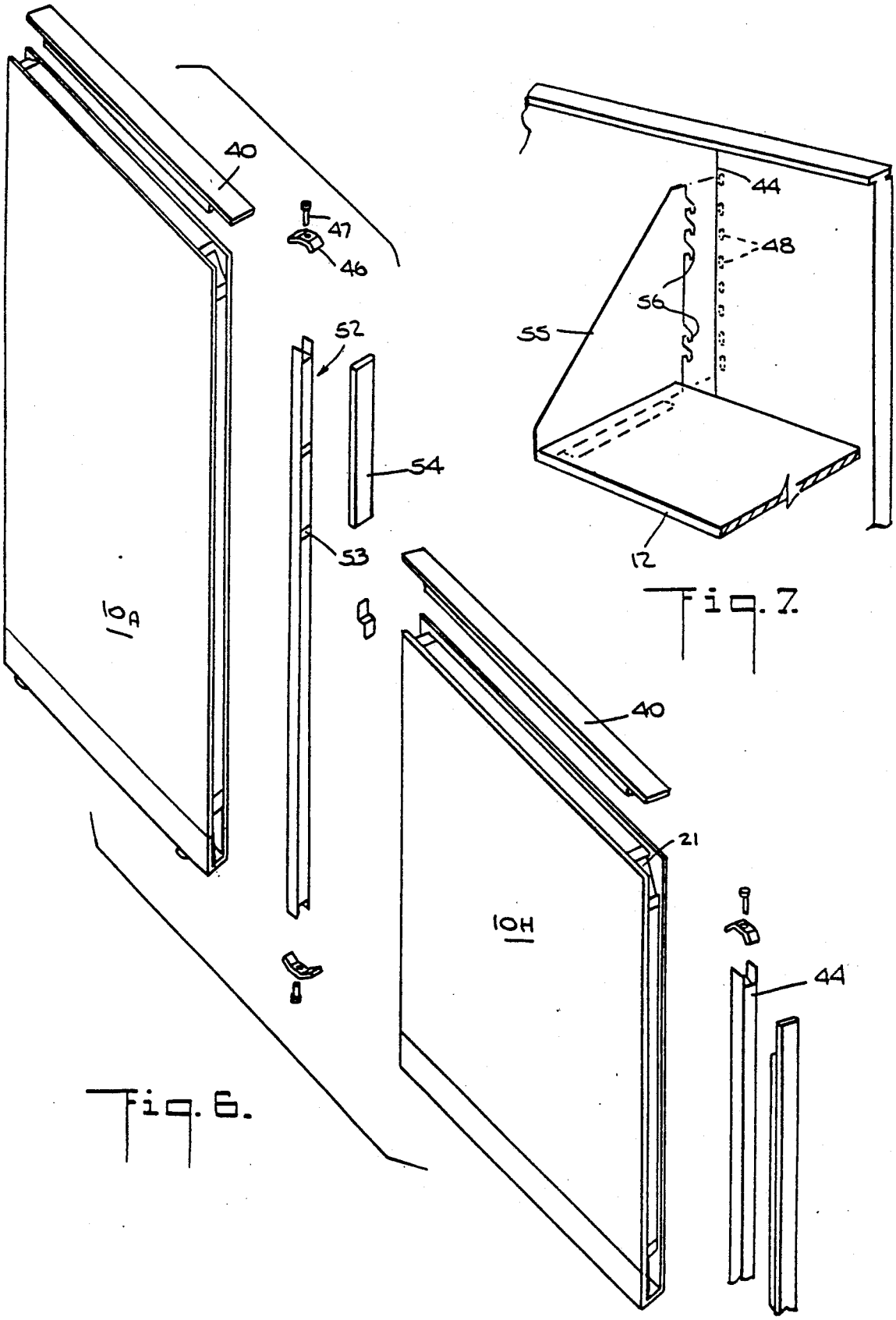
FIG. 6 is a perspective view illustrating how two modular panels, one taller than the other, are joined together.
FIG. 7 is a perspective view illustrating how a bracket for supporting a work component is suspended from a standard sandwiched between two modular panels.

In some cases, it may be desirable to join two panels together in side-by-side relation in an arrangement in which the panels have different heights, as illustrated in FIG. 6, in which panel 10A is tall and panel 10H is short. To this end, use is made of a special standard 52 which is sandwiched between the vertical sides of panels 10A and 10H, standard 52 having side struts 53 making it possible to join the upper left corner of the frame of the short panel to a strut 53 at a corresponding height by means of a clip 21.

The upper end of standard 53 is joined to the upper right corner of the frame of panel 10A by a clamp 46 which is secured to the standard. The lower end of the two panels are locked together by a clamp 46 which bridges the horizontal struts on these panels.

Because of the difference in height, an upper portion of the vertical side of the taller panel 10A is exposed, and this is covered by a snap-in short moulding piece 54.

Work Components

The various work components, such as shelf 12 shown in FIG. 1, which are mounted on the panels are provided, as shown in FIG. 7, with brackets 55 whose rear edge has a row of hooks 56. These are received in the notches 48 in the standard interposed between the panels, thereby cantilevering the work component from the standard. The notches are of double width and can therefore accept a pair of brackets, so that two work components may be cantilevered in side-by-side relation without any space therebetween.

Since there is a standard at the junction of every two panels, one has merely to design each work component so that the rear brackets are in line with the standards. A work component must have at least two spaced-apart brackets so that it can be stably supported from a partition wall; and in some cases where the work component is long, it may have three or four brackets.

Since the work components simply hook onto the standards, it is a simple matter when replacing a component or disassembling the entire structure to remove the components from the partition walls.

It is to be noted in FIG. 17 that the outer fabric sheets of adjoining panels, since they are curled at their margins into the storage channels/project somewhat beyond the sides of the frames; hence fabrics act to conceal the standards at the frame junctions to enhance the attractiveness of the structure. This also applies to the work component brackets which extends between the fabric edges.

Thus the system is highly flexible; for one may interlock the panels to create a large range of different spatial patterns having a right angle geometry to exploit an available interior space to best advantage.

While there has been shown and described a preferred embodiment of a spacer divider system in accordance with the invention, it will be appreciated that many changes and modifications may be made therein without, however, departing from the essential spirit thereof. It is to be noted that the bent metal clips 21 for joining the mitered pieces of the frame together are not the invention of the applicant herein, these clips being the invention of Robert E. Reuter.

I claim:

1. In an office system of interconnected panels and posts, the improvement for interconnecting a first panel to an adjacent second panel or post and also providing a support for accessory components in the region between said first panel and adjacent second panel or post comprising a standard adapted to be positioned between said first panel and said adjacent second panel or post, said standard having opposing sides and front and rear faces, wedging means at both ends of said standard for placing said standard in tension by drawing said first panel and said adjacent second panel or post against the opposing sides of said standard, said standard also including support means on at least one face thereof for supporting one or more accessory components therefrom, which support means are exposed when said first panel is interconnected to an adjacent second panel or post, each component accessory being provided with a bracket that hooks onto the exposed support means on the face of the standard, the other exposed face of the standard being provided with support means for supporting a component accessory therefrom, which support means are exposed when said first panel is interconnected to an adjacent second panel or post.

* * * * *